US005460232A

United States Patent [19]

Burns et al.

[11] Patent Number: 5,460,232

[45] Date of Patent: Oct. 24, 1995

[54] ROTARY EARTH DRILL BIT SOCKET SHIELD

[75] Inventors: Raymond W. Burns, Bethalto, Ill.; Kyle D. Oberlander, Florissant, Mo.

[73] Assignee: Central Mine Equipment Company, Earth City, Mo.

[21] Appl. No.: 280,063

[22] Filed: Jul. 25, 1994

[51] Int. Cl.[6] ..... E21B 10/62

[52] U.S. Cl. ..... 175/427; 175/432

[58] Field of Search ..... 175/425–430, 175/432

[56] References Cited

U.S. PATENT DOCUMENTS 3,342,532 9/1967 Krekeler ..... 175/427 X 4,334,585 6/1982 Upton ..... 175/432

*Primary Examiner*—Michael Powell Buiz

*Attorney, Agent, or Firm*—Polster, Lieder, Woodruff & Lucchesi

[57] ABSTRACT

In a rotary earth drill in which sockets are welded to and spaced around a head and drill bits are removably mounted in the sockets, the sockets having a surface exposed to abrasion when the drill is rotated in the earth, a shield in the form of a shroud or jacket is provided, removably mounted on the socket, and extending around the otherwise exposed surface of the socket to protect the socket surface from abrasion. When the shield itself becomes worn, it can easily be removed, in much the way in which the bits are removed, and replaced. In order to accommodate the weld by which the socket is secured to the drill head, the shield is provided with a slot, open at at least one end. The slot is wide enough to permit side edges defining the slot to straddle the weld.

10 Claims, 1 Drawing Sheet

ROTARY EARTH DRILL BIT SOCKET SHIELD

BACKGROUND OF THE INVENTION

In some rotary earth drills, particularly of the coring type, drill bit sockets or pockets are welded to and spaced around side surfaces of a drill head. Drill bits with shanks shaped complementarily to the bore or socket of the drill sockets are held in position in the sockets by pins that extend through holes or a channel in the drill bit shank and through holes in the side wall of the socket.

The bits are expected to wear and to be replaced, which is easily accomplished by pulling the pin and installing a new bit. However, when the socket itself becomes worn, eroded by the often abrasive materials through which it passes and in which it rotates, its replacement requires that the drill head itself substantially be rebuilt. The old socket has to be cut away and a new one welded into place. This is time consuming and expensive.

One of the objects of this invention is to provide a way to protect the sockets from wear. Other objects will become apparent to those skilled in the art in the light of the following disclosure and accompanying drawing.

SUMMARY OF THE INVENTION

In accordance with this invention generally stated, in a rotary earth drill in which sockets are spaced around a head and drill bits are removably mounted in the socket, the sockets having a surface exposed to abrasion when the drill is rotated in the earth, a shield in the form of a shroud or jacket is provided, removably mounted on the socket, and extending around the otherwise exposed surface of the socket to protect the socket surface from abrasion. When the shield itself becomes worn, it can easily be removed, in much the way in which the bits are removed, and replaced.

In order to accommodate the weld by which the socket is secured to the drill head, the shield is provided with a slot, in the preferred embodiment extending through one edge of the shield but terminating short of an opposite edge of the shield. The slot is wide enough to permit side edges defining the slot to straddle the weld. A ring, integral with the uninterrupted end of the shield, extends around the bit, and preferably is provided with a radially inwardly extending ledge that overhangs a margin of the socket.

DRAWING

DESCRIPTION OF THE PREFERRED EMBODIMENT

Figure 1:
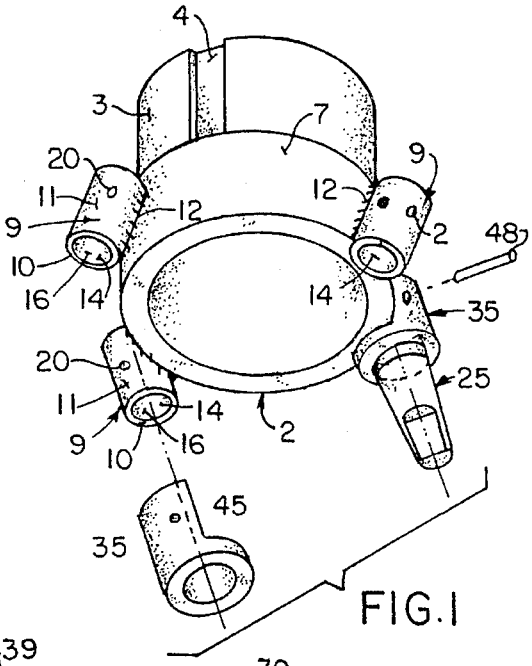
FIG. 1 is an exploded view of a drill head with bit sockets around its side wall, on one of which a shield of this invention is installed, and on another of which a shield is being installed.
Figure 2:
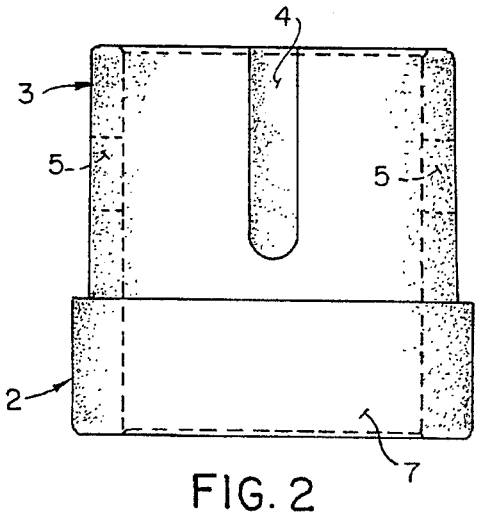
FIG. 2 is a view in side elevation of the drill head without the sockets.

Referring now to the drawing for one illustrative embodiment of this invention, reference numeral 1 indicates a drill head, with a head ring 2 and a shank 3 that has a keyway 4 extending axially of the shank to receive a spine or key in a drill string. The shank 3 also has bolt holes 5 through it, by which the drill head is mounted to the drill string. The head ring 2 has a cylindrical side surface 7, to which bit sockets 9 are welded. The bit sockets have a wall 10 with a cylindrical outer surface 11. A weld line 12, between the cylindrical outer surface 11 of the socket and the side surface 7 of the head ring 2 extends in a generally straight line. The sockets 9 have an inner surface 14 defining a socket bore 15. The socket bore 15 has a tapered section 17, tapering radially inwardly in a direction away from an open mouth 16, and a cylindrical section 18, of a slightly smaller diameter than the inner end of the tapered section 17, so as to provide a shoulder 19. Chordally aligned openings 20 are provided in the cylindrical section 18.

Bits 25 are seated in the sockets 9. In this illustrative embodiment, the bits 25 are shown as having a shank end 28 that is seated in the socket 9 and an outer end 27 with a flat 26, to which a carbide insert is secured. The outer end projects from the socket. The shank 28 has a tapered section 29 complementary to the tapered section 17 of the socket, and a cylindrical section 30, complementary to the cylindrical section 18 of the socket. In the cylindrical section 30 of the shank 28, a chordal, open ended passage 31 in the form of a hole entirely through it is aligned with the aligned openings 20 in the socket.

The drill head 1, the sockets 9, and the bits 25 are all more or less conventional, differing only in the shank configuration and internal socket configuration. The configuration shown is thought to be unique, but the configuration can be varied in any desired way.

Figure 4:
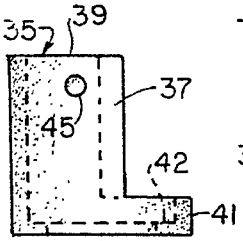
FIG. 4 is a view in side elevation of one embodiment of shield of this invention.
Figure 5:
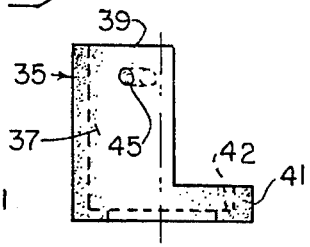
FIG. 5 is a view in side elevation turned a few degrees from FIG. 4.
Figure 3:
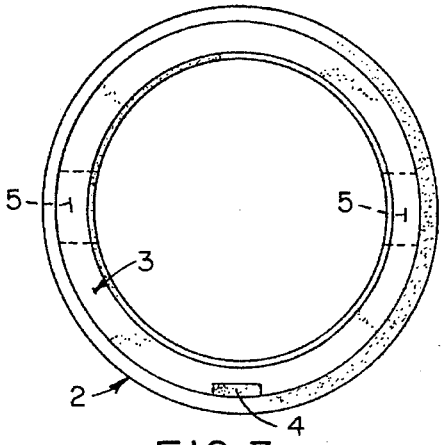
FIG. 3 is a view in bottom plan of the drill head shown in FIG. 2.
Figure 6:
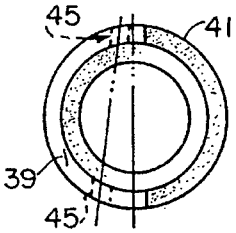
FIG. 6 is a top plan view of the shield shown in FIGS. 4 and 5.
Figure 7:
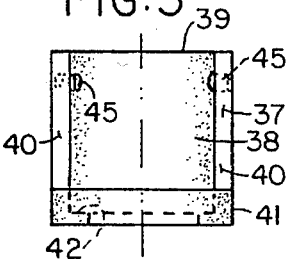
FIG. 7 is a view in side elevation viewed from right to left of FIG. 4.
Figure 8:
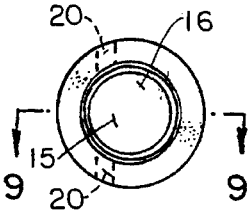
FIG. 8 is a bottom plan view of a socket.
Figure 9:
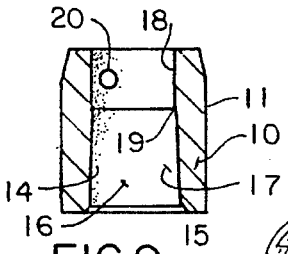
FIG. 9 is a sectional view taken along the line 9—9 of FIG. 8.
Figure 10:
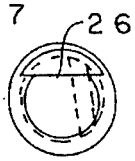
FIG. 10 is a bottom plan view of a bit.
Figure 11:
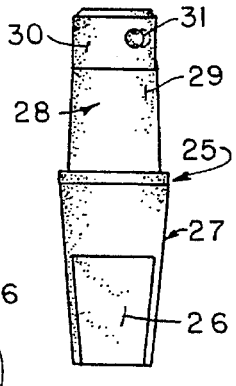
FIG. 11 is a view in front elevation of the bit of FIG. 10.
Figure 12:
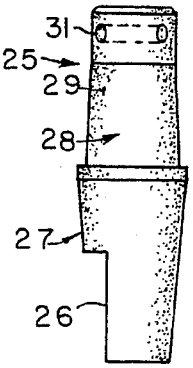
FIG. 12 is a view in side elevation of the bit shown in FIGS. 10 and 11.

Referring now to FIGS. 1, 4, 5, 6 and 7, reference numeral 35 refers to a shield of this invention. The shield 35 has a side wall 37 which is interruptedly cylindrical in shape with an axially extending opening or slot 38 extending from an upper edge 39 to an inner edge of a ring 41. The ring 41 has a lip 42 extending radially inwardly. Chordally aligned openings 45 in the side wall 37 are positioned to be aligned with the openings 20 in the sockets 9, and the passage 31 in the bits 25. A pin 48, passing through the openings 45 and 29 and through the passage 31 holds the shield 35 and bit 25 in place.

As can be seen, the inside surface of the wall 37 of the shield 35 is configured and dimensioned to embrace a radially outer side surface of the socket 9, with edges 40 defining the slot 38 straddling the weld lines 12, to permit the shield to be slid on to the sockets. The lip 42 overlaps the edge of the socket defining the mouth 16, while permitting the installation of the bit 25.

In assembling the drill bit, it is only necessary to slip on the shield, insert the bit, and insert the pin 48. In replacing the bit, the pin is driven out, the worn bit removed, and a new bit inserted. When the shield 35 becomes abraided to the point at which it needs to be replaced, when the pin 48 is driven out, the shield is merely slipped off and replaced with a new one. In this way, the socket remains unworn, and should last indefinitely. This means that the socket does not have to be cut off of the head, and a new one welded in its place. This saves down time, labor and expense.

Numerous variations in the construction of the shield and its assembly will become apparent to those skilled in the art in the light of the foregoing disclosure. Merely by way of example, the outer configuration of the sockets can be varied, and the internal configuration of the shield varied accordingly, so long as the shield can be pulled and installed. The external configuration of the shield can also be varied, for example to thicken the section most subject to wear. The configuration of the drill head is largely irrelevant. Different types of drill heads can be employed. The one illustrated is for a coring drill. Different types of bits can be employed, for example one with an annular channel, rather than a passage 31, and with different cutter end configurations. This is especially useful in those applications in which the bit is to rotate in the socket. In the embodiment shown, the shield is made of 4140 steel, but other materials can be used. The retaining pin can take the form of a nail, or cotter pin, as well as a special cylindrical pin, wire or rod. The ring and lip of the shield can be modified or even eliminated, although the preferred embodiment has a number of advantages in strengths, proper axial orientation of the shield, and protection of the socket. The provision of passages aligned with pin-receiving passages in the socket and bit, so that one pin holds both the shield and the bit, makes for a simple, economical arrangement, but separate mounting means may be provided for the shield from those for the bits. The chordal orientation of the passages permits bits with either holes through them or with a passage defined by an annular groove with groove-defining surfaces above and below a pin to be used. For use with bits with a hole through them, the holes and passages can be diametric or even blind, but the chordal passages are preferred for the strength and versatility of the arrangement. These are merely illustrative.

We claim:

1. In a rotary earth drill in which sockets are spaced around a head and drill bits are removably mounted in the sockets, said sockets having surface exposed to abrasion when said drill is rotated in the earth, the improvement comprising shields, removably mounted on said sockets, extending around said socket surface for protecting said socket surface from abrasion, and means for selectively mounting said shields on and demounting them from said sockets.

2. The improvement of claim 1 wherein said sockets are welded to said head generally linearly along an outside surface of said socket contiguous said head and said shields have an opening complementary to said weld to permit said shields to be slid over said sockets.

3. The improvement of claim 2 wherein said opening extends through an upper edge but short of a lower edge of said socket and said shield has at a lower end a ring encircling the bit, with a ledge extending over a radially outer margin of said socket.

4. The improvement of claim 2 wherein said sockets have a side wall with a cylindrical outside surface, circular in plan, said welds extending parallel to tangential line of contact between sockets and said head, and said shield has an interruptedly cylindrical side wall configured and dimensioned complementarily to said socket cylindrical side wall.

5. The improvement of claim 1 including single pin means for removably mounting said shields and bits.

6. The improvement of claim 5 wherein said shields and sockets have chordally aligned holes in side walls thereof and said mounting pin means extend through said aligned holes.

7. The improvement of claim 6 wherein the bits have parts above and below said pins.

8. In a rotary earth drill with a cylindrical drill head and a plurality of sockets, each with a cylindrical outer surface, spaced circumferentially around said drill head, said sockets being secured to said drill head by a weld extending along a line generally parallel to a center line of said sockets cylindrical surface, each of said sockets having an open mouth and a bore, chordally aligned holes through walls defining said outer surface and an inner surface of said bore, for receiving a retaining pin; bits mounted in said socket bores, said bits having a part positioned below said aligned holes with a space thereabove to accommodate said retaining pin, the improvement comprising a hollow, open-ended shield having an elongated cylindrical side wall with a slot, opening through an upper edge of said side wall and extending lengthwise of said side wall but ending short of a lower end thereof, said slot being of a width to straddle said weld; said shield having a ring encircling said bit, and a radially inwardly extending lip extending over a margin of a wall defining said socket mouth, said shield being sized to slide over and around the outside of said socket side wall between said weld, said shield side wall having chordally aligned holes aligned with said chordally aligned socket holes to receive said pin, whereby both the shield and the bit are selectively mounted and demounted by inserting and removing said pin.

9. The improvement of claim 8 wherein the socket bore is defined by a wall part tapering radially inwardly from the mouth of the socket in a direction toward the upper end of the bore but short of the upper end, and a cylindrical part extending from an inner end of said tapered part to an upper end of said bore, and a shank end of said bit is shaped complementarily to said bore.

10. The improvement of claim 9 wherein the wall defining the cylindrical part of said bore has chordally aligned passages through it and said bit has a chordal hole through it aligned with the chordal passages in the said socket wall.

* * * * *